US005117759A

United States Patent [19]

Henderson et al.

[11] Patent Number: 5,117,759

[45] Date of Patent: Jun. 2, 1992

[54] FILAMENTARY COMPOSITE DUAL WALL WARHEAD

[75] Inventors: William M. Henderson, Ninde; Charles R. Garnett, Dahlgren; Leonard T. Wilson, Fredericksburg, all of Va.

[73] Assignee: The United States of America as represented by the Secretary of the Navy, Washington, D.C.

[21] Appl. No.: 740,522

[22] Filed: Aug. 5, 1991

[51] Int. Cl.[5] ..... F42B 12/32

[52] U.S. Cl. ..... 102/496; 102/473

[58] Field of Search ..... 102/474, 491–497, 102/389, 489, 506, 473

[56] References Cited

U.S. PATENT DOCUMENTS

| | | | |
|---|---|---|---|
| H160 | 11/1986 | Perry et al. | 102/494 |
| 2,872,865 | 2/1959 | Skaar | 102/473 |
| 3,298,308 | 1/1967 | Throner et al. | 102/494 |
| 3,434,422 | 3/1969 | Herman et al. | 102/474 |
| 3,566,794 | 3/1971 | Pearson et al. | 102/493 |
| 3,696,750 | 10/1972 | Colgate | 102/474 |
| 3,799,054 | 3/1974 | LaRocca | 102/64 |
| 3,815,504 | 6/1974 | Tieben | 102/67 |
| 3,977,327 | 8/1976 | Brumfield et al. | 102/67 |
| 4,216,720 | 8/1980 | Kempton | 102/67 |
| 4,305,333 | 12/1981 | Altenau et al. | 102/306 |
| 4,592,283 | 6/1986 | Hellner et al. | 102/493 |
| 4,781,117 | 11/1988 | Garnett et al. | 102/493 |

FOREIGN PATENT DOCUMENTS

| | | | |
|---|---|---|---|
| 76695 | 10/1961 | France | 102/495 |
| 2523716 | 9/1983 | France | 102/494 |
| 1142716 | 2/1969 | United Kingdom | 102/493 |
| 1503143 | 3/1978 | United Kingdom | 102/491 |

*Primary Examiner*—Harold J. Tudor

*Attorney, Agent, or Firm*—John D. Lewis; Kenneth E. Walden

[57] ABSTRACT

The conventional missile warhead is replaced by a dual wall composite fragmenting warhead. This design consists of two concentric composite shells which sandwich a layer of fragmentation material. All missile structural loads are carried by the shells. The warhead is connected to the rest of the missile through end joints rigidly attached to the shells.

9 Claims, 3 Drawing Sheets

FILAMENTARY COMPOSITE DUAL WALL WARHEAD

The invention described herein may be manufactured and used by or for the Government of the United States of America for governmental purposes without the payment of any royalties thereon or therefor.

BACKGROUND OF THE INVENTION

The field of the invention is that of ordnance and warhead construction. In particular, the present invention relates to fragmentary warhead construction.

In the prior art, most missile fragmentation warheads either use a solid steel case filled with explosive (which is the conventional design) or consist of explosive surrounded by a thin shell with "discrete" fragments glued to the shell which is generally called the discrete fragment design. In either case the warhead is then mounted into the ordnance section where structural loads are carried by a surrounding shroud.

An example of the conventional steel case design is LaRocca, U.S. Pat. No. 3,799,054 filed Mar. 26, 1974. This reference teaches a warhead for controlling the fragmentation of explosive devices having a cylindrical metallic fragmentation casing, wrapped with metallic strips of heavy density to cause fragments to form. This type of construction employs heavy construction materials which, by necessity, must be massive in areas that optimum airframe design would dictate a lighter or different design. This conventional warhead highlights the design tension between fragmentation and structural integrity. Generally a missile airframe demands light, strong materials, and warhead fragments need to be heavy, close tolerance, objects. Methods for achieving uniform fragmentation are generally not consistent with good airframe design.

In small missiles it is conventional for the warhead case to double as both the fragmentation panel and the load bearing member of the airframe. This engenders a conflict between the need for strength in the load bearing member and the need to score this member to form fragments. Alternate methods of forming fragments, using discrete pellets, require subcaliber techniques which lower lethality and require the fragments to blow through the metallic shroud material, which further degrades kill performance.

An example of discrete fragment design is represented by Brumfield et al., U.S. Pat. No. 3,977,327 filed Aug. 31, 1976. The Brumfield et al. reference is typical of many fragmentation schemes which precut fragments and then sandwich them between steel/aluminum cylinders to form the case or missile airframe. The required airframe structure then becomes parasitic weight from a warhead design perspective.

In a like manner, both the discrete fragment and the conventional designs share a common flaw from the overall system perspective. In both designs the warhead is usually carried as parasitic weight within a surrounding missile shroud. There are two drawbacks to this. First, the warhead is forced to "blow" through the shroud. Having to do this degrades fragment breakup as well as fragment velocity. Second, to minimize fragment degradation the missile shroud is made as thin and light as possible in the blow through area thereby reducing the shroud's structural integrity.

This parasitic weight issue can be alleviated to some degree by utilizing an integral warhead with a removable explosive assembly. However, this option suffers from an inability to customize fragmentation and from a weight penalty caused by using steel shroud.

Another recent concern in the warhead arts is the development of warheads that are safe to carry on our nation's ships and aircraft. These concerns are reflected in the new insensitive munitions requirements which became effective to all naval munitions in 1987. One of these requirements is that a warhead survive a fire or high heat environment without exploding. The steel or metallic case warheads do not allow the venting necessary so that the explosive mix burns rather than explodes. Elaborate cook-off plugs and other schemes to allow venting further degrade the case integrity and further reduce strength.

The disadvantages of the conventional design and the discrete fragment design are overcome by the present invention which provides a lightweight warhead case that integrates into the missile as a load bearing section without adding parasitic weight or degrading lethality, while still exhibiting the advantages of discrete fragments and safety.

SUMMARY OF THE INVENTION

The present invention consists of two concentric cylindrical shells which sandwich a fragment layer. All axial, shear, and bending loads of the delivery vehicle will be carried by the cylindrical shells. The ordnance section is connected to the rest of the missile through end joints rigidly attached to the shells. Fragmentation may be provided by using either discrete fragments or fragmenting material. A secondary function of the inner shell is to contain the warhead's explosive. A removable explosive assembly can be configured for this design.

In the preferred embodiment all shells would be constructed using filamentary laminated composite materials. Forward and aft covers for the warhead could be made using either a laminated composite, metal, or an engineering plastic. End joints for the ordnance section would be constructed from many materials, including a high strength galvanically compatible metal like titanium or composites.

Finally, the dual wall discrete fragment warhead should be much easier to produce. The composite shells could be belt wound to their final shape. On the other hand, a conventional structure would require a large amount of machining. The only portion of the design requiring a major machining operation would be the end joints.

Therefore, an object of the present invention is to teach a warhead design that minimizes parasitic weight.

Another object of the instant invention is to provide a warhead that can sustain a high heat environment without detonation.

A further object of the present invention is to teach a warhead design that is low cost and easy to manufacture.

Yet another object of this invention is to increase lethality of a warhead.

Other objects, advantages and novel features of the invention will become apparent from the following detailed description of the invention when considered in conjunction with the accompanying drawings which show an advantageous embodiment of the invention and wherein like numerals designate like parts in the several figures, and wherein:

5D illustrates a fragmentation blanket which is presented as an optional fragmentation scheme usable with the present invention.

DETAILED DESCRIPTION

Figure 1:
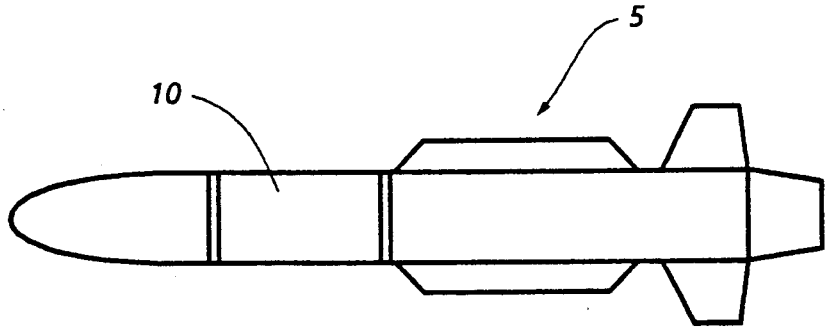
FIG. 1 is an illustration of a missile containing the filamentary composite dual wall warhead of the present invention.

Referring in detail to FIG. 1 wherein a filamentary composite dual wall warhead 10 of the present invention is illustrated in its preferred embodiment as an integral load bearing section of missile 5.

Figure 2:
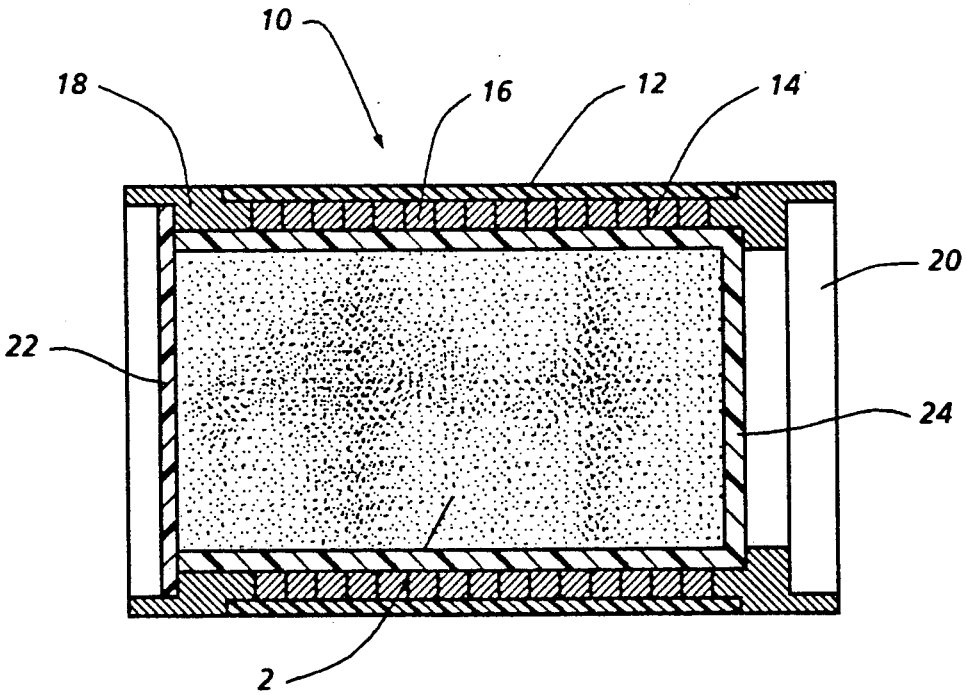
FIG. 2 is a sectioned, longitudinal view of the filamentary composite dual wall warhead in its preferred embodiment.

FIG. 2 shows the filamentary composite dual wall warhead 10 in its preferred embodiment. The warhead 10 consists of an outer shell 12 and inner shell 14 that sandwich a fragmentation layer 16. The shells (items 12 and 14) are rigidly attached to the forward 18 and aft 20 end members which act as supports and also connect the warhead to the other sections of the missile 5. Forward 22 and aft 24 end caps are then attached to the appropriate end members. High explosive (HE) 2 can then be positioned in the cavity formed by the inner shell 14 and aft end cap 24. It is also possible to make the inner shell 14 and aft end cap 24 an integral unit if both parts were to be made from the same materials. Note that the greatest benefits of this design are gained when its application is limited to smaller caliber missiles, as the structural efficiency of the double shells will degrade with increasing diameter. At some point, the device described in Applicants' copending application entitled "Composite Sheet Stringer Ordnance Section", Ser. No. 07/740,523 would become the preferred alternative based on structural concerns.

Still referring to FIG. 2, note that the inner 14 and outer 12 shells would be constructed using a laminated filamentary composite material, an example of which is graphite-epoxy. The primary purpose of the shells 12 and 14 is to carry the axial, shear, and bending loads required by the missile 5. By making the shells 12 and 14 using composite materials, they can be more readily tailored to meet the imposed loading conditions, thus increasing structural efficiency and thereby minimizing weight. In this way the warhead 10 can meet the missile airframe demands of a strong, yet relatively light, weight structure. The secondary purpose of the shells 12 and 14 is to prevent detonation of the HE 2 when the warhead 10 is unintentionally subjected to a high temperature environment, such as a fuel fire. In a fuel fire or other high temperature situation, the shells 12 and 14 would melt thereby letting the HE 2 gases vent. This venting permits the HE 2 to burn freely. Any significant containment would lead to a detonation or deflagration.

Returning to FIG. 2, the forward 18 and aft 20 end members may be viewed. One purpose of these members is to provide rigid support for the inner 14 and outer 12 shells, and concurrently provide a means of joining the warhead to the other sections of the missile air frame. To accomplish these tasks efficiently, the end members should be constructed using galvanically compatible materials with high stiffness to weight and strength to weight ratios. Examples include titanium alloys, corrosion resistant steel alloys, and composites such as graphite epoxy. A second purpose of the end members 18 and 20 is to provide an attaching point for the forward 22 and aft 24 end caps .

The main purposes of the end caps 22 and 24 would be to provide a closed cavity for the HE 2 and, in a high temperature environment, allow for additional venting. To accomplish these tasks in an efficient manner, the best material candidates would be either laminated composites or engineering plastics. As mentioned earlier, the aft end cap 24 could be combined with the inner shell 14 to make one integral unit.

Figure 3:
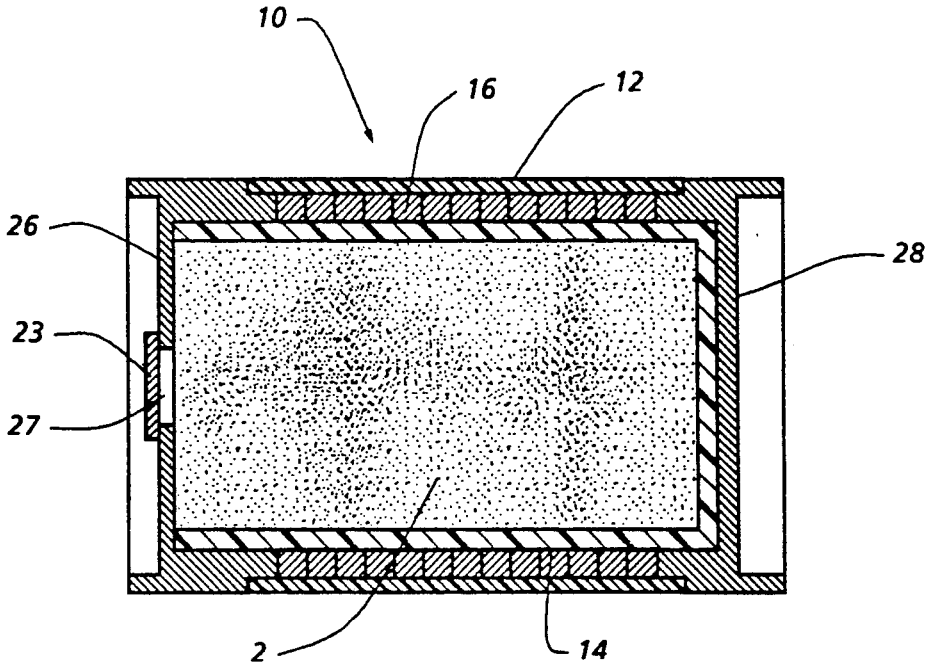
FIG. 3 is a view of an alternate embodiment of the warhead of the present invention.

FIG. 3 shows an alternate embodiment where the end caps 22 and 24 shown in FIG. 2, and the end members 20 and 22 shown in FIG. 2, have been replaced with integral bulkhead assemblies. The forward assembly is numeral 26 while the aft bulkhead assembly is designated 28. The bulkhead assemblies serve to contain the explosive, support the inner 14 and outer 12 shells, and connect the warhead to the rest of the missile. These bulkheads 26 and 28 would also be fabricated using materials that are galvanically compatible with the inner and outer shells and missile airframe. In the embodiment chosen for illustration in FIG. 3, bulkhead 26 is shown with an optional opening 27 which allows a poured HE 2 to be loaded into the warhead after assembly. In this optional version, opening 27 would be sealed after warhead loading with a plug 23.

Figure 4:
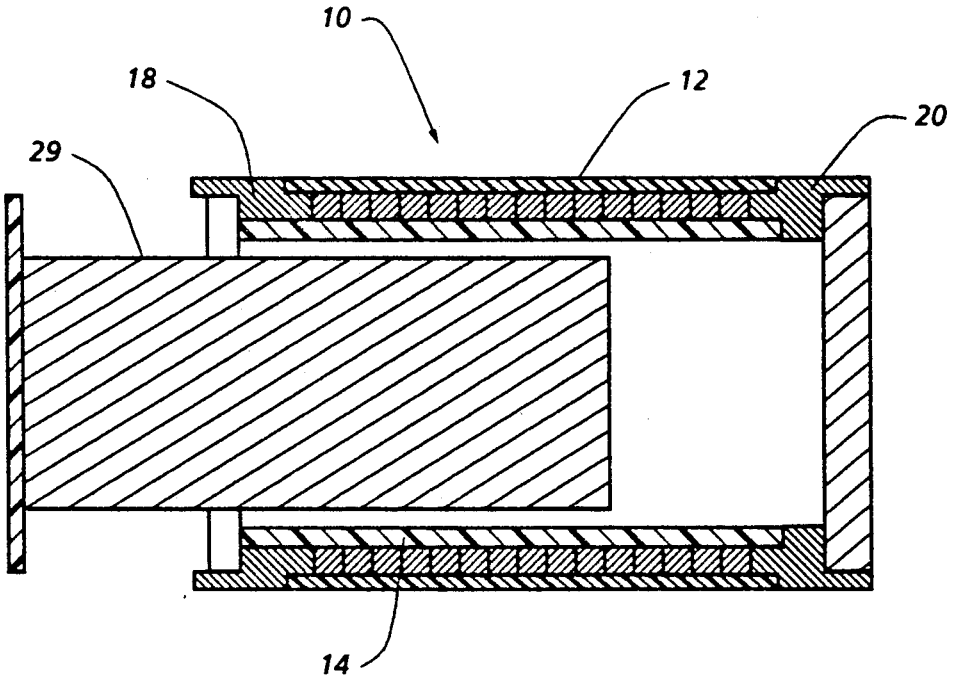
FIG. 4 is a sectioned, longitudinal view of the filamentary composite warhead configure for use with a removable explosive assembly.
Figure 5A:
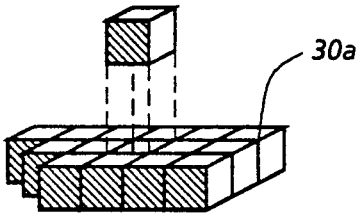
FIG. 5A illustrates an isometric view of one fragmentation option available with the present invention.
Figure 5B:
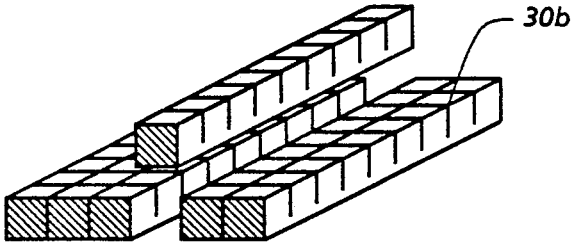
FIG. 5B illustrates an isometric view of a scored rod fragmentation option available with the present invention.
Figure 5C:
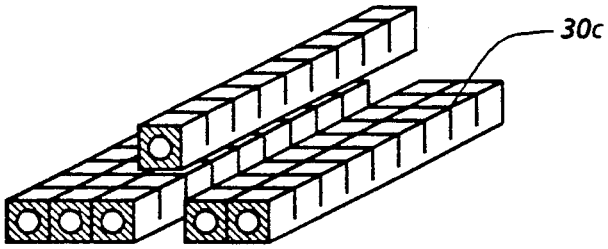
FIG. 5C illustrates an isometric view of a fragmentation notched rods available with the present invention.
Figure 5D:
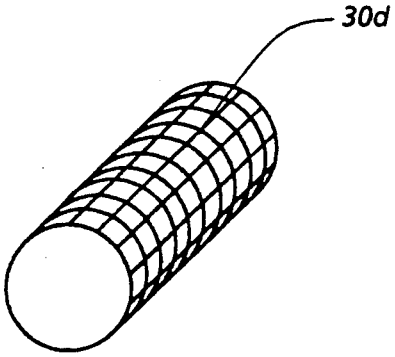

FIG. 4 illustrates still another concept where a removable explosive assembly 29 can be used with the dual wall concept. Modular warhead construction is the teaching of Garnett, et al., entitled "Fragmentable Warhead of Modular Construction" issued Nov. 1, 1988, and bearing U.S. Pat. No. 4,781,117. U.S. Pat. No. 4,781,117 is herein incorporated by reference. Finally, the composite dual wall warhead is amenable to an infinite number of fragmentation schemes. The fragmentation layer 16 would be defined by the warhead designer. Turning to FIG. 5A through 5D, four of the more likely fragmentation blankets are shown. Item **30*a*, shown in FIG. 5A, would be the discrete fragment option. Here individual fragments would be sandwiched between the inner 14 and outer 12 shells. Alternatives on this option which a person of ordinary skill in the art might consider as a design choice, would be fragmenting notched rods 30*b* shown in FIG. 5B and composite fragmenting rods 30*c* of FIG. 5C. These rods are deeply scored to form individual fragments upon detonation and may be made of various known fragmenting material. Finally, a cylindrical fragment blanket may be used as in 30*d* FIG. 5D**. Various other fragmentation techniques will be recognized as alternatives to the warhead designer and the particular technique employed is considered a design choice. Obviously many modifications and variations of the present invention are possible in the light of the above teachings.

What we claim is:

1. A dual wall fragmenting warhead for a missile comprising:

an outer load bearing laminated filamentary composite shell of substantially uniform thickness comprising a section of an outside airframe of a missile;

an inner load bearing laminated filamentary composite shell of substantially uniform thickness sized to fit within the inner circumference of said outer shell whereby said outer load bearing shell and said inner load bearing shell cooperate to form the structural airframe of a missile segment;

a layer of fragmentation material selected from a group consisting of discrete fragments, discrete fragmenting rods, and discrete composite fragmenting rods sandwiched between said inner and said outer load bearing shells whereby said fragmentation material is free of structural loading;

a forward annular member attached to said inner and said outer load bearing composite shells to provide structural support; and an aft annular member attached to said inner and outer load bearing composite shells to provide structural support; and an explosive charge disposed within said inner load bearing composite shell.

2. A fragmenting warhead according to claim 1 wherein said forward annular member and said aft annular member are solid bulkheads forming a one piece end closure whereby the warhead is sealed to contain said explosive charge.

3. A fragmenting warhead according to claim 2 wherein said forward annular member and said aft annular members are fabricated of composite material.

4. A fragmenting warhead according to claim 1 further defined by:

a forward end cap comprising a solid planar one piece bulkhead disposed substantially normal to the longitudinal axis of the warhead affixed to said forward annular member, and an aft end cap comprising a solid planar one piece bulkhead disposed substantially normal to the longitudinal axis of the warhead affixed to said aft annular member whereby the warhead is sealed to contain explosives.

5. A fragmenting warhead according to claim 4 wherein said forward and said aft end caps are constructed of composite material.

6. A fragmenting warhead according to claim 1 wherein said inner and said outer laminated filamentary composite shells are constructed of graphite epoxy.

7. A fragmenting warhead according to claim 6 wherein said forward annular member and said aft annular member are fabricated from a metal that is galvanically compatible with graphite epoxy.

8. A fragmenting warhead according to claim 1 wherein said forward annular member and said aft annular member are fabricated of composite material.

9. A fragmenting warhead according to claim 1 wherein said explosive charge is fabricated as a removable explosive cartridge.

* * * * *